US008766964B2

(12) United States Patent
Yamamoto et al.

(10) Patent No.: US 8,766,964 B2
(45) Date of Patent: Jul. 1, 2014

(54) IMAGE DISPLAY DEVICE

(75) Inventors: Shoji Yamamoto, Fujisawa (JP); Junichi Yokoyama, Fujisawa (JP); Masahisa Tsukahara, Fujisawa (JP)

(73) Assignees: Japan Display Inc., Tokyo (JP); Canon Kabushiki Kaisha, Tokyo (JP)

( * ) Notice: Subject to any disclaimer, the term of this patent is extended or adjusted under 35 U.S.C. 154(b) by 281 days.

(21) Appl. No.: 13/114,086

(22) Filed: May 24, 2011

(65) Prior Publication Data

US 2011/0292019 A1 Dec. 1, 2011

(30) Foreign Application Priority Data

May 25, 2010 (JP) ..... 2010-119153

(51) Int. Cl.
*G09G 5/00* (2006.01)

(52) U.S. Cl.
USPC ..... 345/211; 345/46; 345/54; 345/82

(58) Field of Classification Search
CPC ..... G09G 5/00; G09G 3/3655
USPC ..... 345/76, 46, 54–55, 82, 211–213
See application file for complete search history.

(56) References Cited

U.S. PATENT DOCUMENTS

2005/0088378 A1* 4/2005 Ozawa et al. ..... 345/76
2005/0140596 A1* 6/2005 Lee et al. ..... 345/76

FOREIGN PATENT DOCUMENTS

JP 2005-91724 4/2005
JP 2008-170788 7/2008
JP 2009-139823 6/2009

OTHER PUBLICATIONS

Partial translation of the office action for Japanese Patent Application No. 2010-119153, issued on Mar. 18, 2014.

* cited by examiner

*Primary Examiner* — Joseph Feild
*Assistant Examiner* — Andrew Sasinowski
(74) *Attorney, Agent, or Firm* — Antonelli, Terry, Stout & Kraus, LLP.

(57) ABSTRACT

Provided is an image display device including: a pixel circuit; a power supply line; a data line for supplying a data signal to the pixel circuit; and a current path control unit. The pixel circuit includes: a light emitting element; a drive transistor for controlling a current flowing to the light emitting element; a storage capacitor provided between the data line and a gate electrode of the drive transistor, for storing a potential difference; and a data line connection switch for connecting one end of the storage capacitor on the gate electrode side of the drive transistor and the data line. Before the data line supplies the data signal, the data line connection switch is turned ON, and the current path control unit interrupts a current path from the power supply line to the one end of the storage capacitor.

15 Claims, 15 Drawing Sheets

IMAGE DISPLAY DEVICE

CROSS-REFERENCE TO RELATED APPLICATION

The present application claims priority from Japanese application JP 2010-119153 filed on May 25, 2010, the content of which is hereby incorporated by reference into this application.

BACKGROUND OF THE INVENTION

1. Field of the Invention

The present invention relates to an image display device, and more particularly, to an image display device using a light emitting element.

2. Description of the Related Art

In recent years, image display devices using a light emitting element, such as organic electroluminescent (EL) display devices, are being actively developed. Pixel circuits constituting the image display device each include a light emitting element, a drive transistor for controlling the amount of current to be supplied to the light emitting element, and a storage capacitor for applying a potential to a gate electrode of the drive transistor. The drive transistor is generally formed by a thin film transistor, which is a type of an electric field effect transistor. In order to prevent degradation in image quality caused by a fluctuation in threshold voltage among the drive transistors, an auto-zero operation is performed. In the auto-zero operation, the gate electrode and a drain electrode of the drive transistor are connected to each other to cause a current to flow until the current stops flowing naturally so that a potential difference corresponding to the threshold voltage is generated between the gate electrode and a source electrode of the drive transistor, and then a potential difference that reflects the potential difference corresponding to the threshold voltage is stored in the storage capacitor. In order to perform the auto-zero operation, it is necessary to previously set a potential of the gate electrode of the drive transistor in a given range. A known method for realizing the preset operation is to supply a potential of a data line to a node to which the gate electrode of the drive transistor is connected.

FIG. 14 is a diagram illustrating an example of the pixel circuit of the conventional image display device. The image display device includes a data line DAT, a power supply line PWR, a selection control line SEL, a lighting reset control line CTL, an initial voltage control line CLR, and the plurality of pixel circuits. The pixel circuits each include a light emitting element IL, a drive transistor TRD, a storage capacitor CP, a selection switch SWS, a lighting control switch SWI, a reset switch SWR, and an initial voltage supply switch SWL. The drive transistor TRD has a source electrode connected to the power supply line PWR and a gate electrode connected to one end of the storage capacitor CP. The selection switch SWS is provided between another end of the storage capacitor CP and the data line DAT, and controlled by the selection control line SEL. A drain electrode of the drive transistor TRD is connected to one end of the lighting control switch SWI, one end of the reset switch SWR, and one end of the initial voltage supply switch SWL. The lighting control switch SWI has another end connected to an anode of the light emitting element IL. The reset switch SWR has another end connected to the gate electrode of the drive transistor TRD. The initial voltage supply switch SWL has another end connected to the other end of the storage capacitor CP.

In a first period before the auto-zero operation is performed, the selection switch SWS, the initial voltage supply switch SWL, and the reset switch SWR are turned ON. Accordingly, a potential of the gate electrode of the drive transistor TRD becomes a potential of the data line DAT. On this occasion, the data line DAT supplies such a potential that turns ON the drive transistor TRD. Next, in a second period in which the auto-zero operation is performed, the initial voltage supply switch SWL is turned OFF. Japanese Patent Application Laid-open No. 2005-91724 discloses an example of the above-mentioned conventional organic electroluminescent (EL) display device.

SUMMARY OF THE INVENTION

For example, in the above-mentioned conventional image display device, voltage drop occurs in the data line DAT when the data line DAT is connected to the one end of the storage capacitor CP provided on the gate electrode side of the drive transistor TRD. This is responsible for non-uniform luminance.

FIG. 15 is a diagram schematically illustrating a resistance of the data line DAT and a resistance of a wiring line connected thereto. When a current flows through the data line DAT extending in a vertical direction of a display region DA, voltage drop occurs due to the resistance of the data line DAT itself. As a result, different potentials are applied to the gate electrodes of the drive transistors TRD included in the pixel circuit connected at the point A and the pixel circuit connected at the point B.

Here, a thin film transistor such as the drive transistor TRD is known to have characteristics (hysteresis characteristics) that its threshold voltage varies with the history of potential differences applied between the gate electrode and the source electrode. The threshold voltage is largely changed at a moment when the potential difference is changed because of the hysteresis characteristics, but thereafter, the threshold voltage gradually converges to a value determined by the potential difference between the gate electrode and the source electrode. The hysteresis characteristics and the difference in potential applied to the gate electrode affect a display luminance. First, at the above-mentioned timing of connection of the data line DAT, the threshold voltage is changed because of the difference in potential applied to the gate electrode of the drive transistor TRD. When a data signal is subsequently stored, the threshold voltage has not converged yet, and hence the storage capacitor CP stores a potential difference so as to cancel the threshold voltage at that time. On the other hand, during an emission period after the data signal is stored, the threshold voltage converges to a voltage which is unrelated to the above-mentioned voltage drop. This causes the threshold voltage to vary between at the timing for storing the data signal and during the light emission. The difference in threshold voltage causes the difference in amount of current that the drive transistor TRD supplies, which becomes visible as the difference in luminance (non-uniform luminance).

The present invention has been made in view of the above-mentioned problem, and an object of the present invention is to provide an image display device capable of suppressing voltage drop that occurs in a data line when the data line is connected to one end of a storage capacitor on a gate electrode side of a drive transistor.

Typical aspects of the invention disclosed in the subject application are briefly summarized as follows.

(1) An image display device, including: a plurality of pixel circuits; a power supply line; a data line for supplying a data signal to each of the plurality of pixel circuits; and a current path control unit, in which: the each of the plurality of pixel circuits includes: a light emitting element which emits light at a luminance corresponding to an amount of current; a drive transistor for controlling a current flowing to the light emitting element; a storage capacitor provided between the data line and a gate electrode of the drive transistor, for storing a potential difference corresponding to a display gray level; and a data line connection switch for connecting one end of the storage capacitor on the gate electrode side of the drive transistor and the data line. Before the data line supplies the data signal to each of the plurality of pixel circuits, the data line connection switch included in corresponding one of the plurality of pixel circuits is turned ON, and the current path control unit interrupts a first current path from the power supply line to the one end of the storage capacitor included in the corresponding one of the plurality of pixel circuits.

(2) In the image display device as described in item (1) of the present invention, when the data line connection switch included in each of the plurality of pixel circuits is turned ON, the current path control unit interrupts the first current path and a second current path from the power supply line to the light emitting element included in corresponding one of the plurality of pixel circuits.

(3) In the image display device as described in item (2) of the present invention, the current path control unit includes: a reset switch provided between the gate electrode and a drain electrode of the drive transistor included in the each of the plurality of pixel circuits; and a lighting control switch for controlling ON/OFF of the current flowing from the drive transistor to the light emitting element included in the each of the plurality of pixel circuits.

(4) In the image display device as described in item (2) of the present invention, the current path control unit includes a power supply control switch provided between the power supply line and a source electrode of the drive transistor included in each of the plurality of pixel circuits.

(5) In the image display device as described in item (4) of the present invention: the current path control unit further includes: a reset switch provided between the gate electrode and a drain electrode of the drive transistor included in the each of the plurality of pixel circuits; and a lighting control switch for controlling ON/OFF of the current flowing from the drain electrode of the drive transistor to the light emitting element included in corresponding one of the plurality of pixel circuits; and when the data line connection switch is turned ON, the reset switch and the lighting control switch are turned ON.

(6) The image display device as described in item (3) or (5) of the present invention, further including: at least one reference potential supply line; and a reference potential supply source for supplying a reference potential, in which: the light emitting element included in each of the plurality of pixel circuits is provided between the drain electrode of the drive transistor included in corresponding one of the plurality of pixel circuits and any one of the at least one reference potential supply line; and the lighting control switch is provided between the any one of the at least one reference potential supply line and the reference potential supply source.

(7) The image display device as described in item (6) of the present invention, further including a plurality of potential adjusting circuits, in which: the plurality of pixel circuits are divided into a plurality of groups depending on an emission color of the light emitting element included in corresponding one of the plurality of pixel circuits; the at least one reference potential supply line, the lighting control switch, and one of the plurality of potential adjusting circuits are provided for each of the plurality of groups; the light emitting element included in the pixel circuit which belongs to one of the plurality of groups is provided between the drain electrode of the drive transistor included in the pixel circuit and the at least one reference potential supply line corresponding to the one of the plurality of groups; the lighting control switch corresponding to any one of the plurality of groups controls connection between the at least one reference potential supply line and one of the plurality of potential adjusting circuits corresponding to the any one of the plurality of groups; and the plurality of potential adjusting circuits each supply a potential corresponding to the corresponding one of the plurality of groups.

(8) In the image display device as described in any one of items (1) to (7) of the present invention, the data line connection switch is a field effect transistor and has a gate electrode supplied with a predetermined potential.

(9) A driving method for an image display device including a power supply line, a data line, and pixel circuits each including a light emitting element which emits light at a luminance corresponding to an amount of current, a storage capacitor, a drive transistor including a gate electrode connected to the data line via the storage capacitor, for controlling a current flowing to the light emitting element based on a potential difference stored in the storage capacitor, a reset switch provided between the gate electrode and a drain electrode of the drive transistor, and a data line connection switch for turning ON/OFF connection between one end of the storage capacitor on the drive transistor side and the data line, the driving method including: a precharge step of turning ON the data line connection switch and interrupting a first path of a current flowing from the power supply line to the one end of the storage capacitor and a second path of a current flowing from the power supply line to the light emitting element; and after the precharge step, a data storing step of inputting, by the data line, a data signal to another end of the storage capacitor while turning ON the reset switch.

(10) In the driving method for an image display device as described in item (9) of the present invention, the precharge step includes turning ON the data line connection switch and turning OFF the reset switch, and interrupting a path of a current flowing from the drain electrode of the drive transistor to the light emitting element.

(11) In the driving method for an image display device as described in item (9) of the present invention, the precharge step includes turning ON the data line connection switch and interrupting a current path between the power supply line and a source electrode of the drive transistor.

(12) In the driving method for an image display device as described in item (11) of the present invention, the precharge step includes turning ON the data line connection switch and interrupting a current path between the power supply line and a source electrode of the drive transistor, and securing a current path from the light emitting element to the one end of the storage capacitor.

(13) In the driving method for an image display device as described in item (11) of the present invention, the precharge step includes turning ON the data line connection switch and interrupting a current path between the power supply line and a source electrode of the drive transistor, and securing a current path from the light emitting element to the one end of the storage capacitor thereafter.

(14) An image display device, including: a plurality of pixel circuits; a power supply line; and a data line for supplying a data signal and an emission control signal to the plurality of pixel circuits, in which each of the plurality of pixel circuits includes: a light emitting element which emits light at a luminance corresponding to an amount of current; a drive transistor including a source electrode connected to the power supply line; a storage capacitor including one end connected to a gate electrode of the drive transistor and another end connected to the data line; a data line connection switch including one end connected to the one end of the storage capacitor, and another end connected to the data line; a reset switch provided between the gate electrode and a drain electrode of the drive transistor; and a lighting control switch provided between an anode of the light emitting element and the drain electrode of the drive transistor.

(15) An image display device, including: a plurality of pixel circuits; a power supply line; and a data line for supplying a data signal and an emission control signal to the plurality of pixel circuits, in which each of the plurality of pixel circuits includes: a light emitting element which emits light at a luminance corresponding to an amount of current; a drive transistor; a storage capacitor including one end connected to a gate electrode of the drive transistor and another end connected to the data line; a data line connection switch including one end connected to the one end of the storage capacitor, and another end connected to the data line; a reset switch provided between the gate electrode and a drain electrode of the drive transistor; a lighting control switch provided between an anode of the light emitting element and the drain electrode of the drive transistor; and a current supply switch including one end connected to the power supply line and another end connected to a source electrode of the drive transistor.

According to the present invention, in the image display device, voltage drop that occurs in the data line maybe suppressed when the data line is connected to one end of the storage capacitor on the gate electrode side of the drive transistor.

DETAILED DESCRIPTION OF THE INVENTION

Hereinafter, embodiments of the present invention are described with reference to the accompanying drawings. Throughout the description, the same reference symbols are attached to components having the same function, and redundant description thereof is omitted. In the following, a case where the present invention is applied to an organic electroluminescent (EL) display device, which is a type of an image display device using a light emitting element, is described.

[First Embodiment ]

Figure 1:
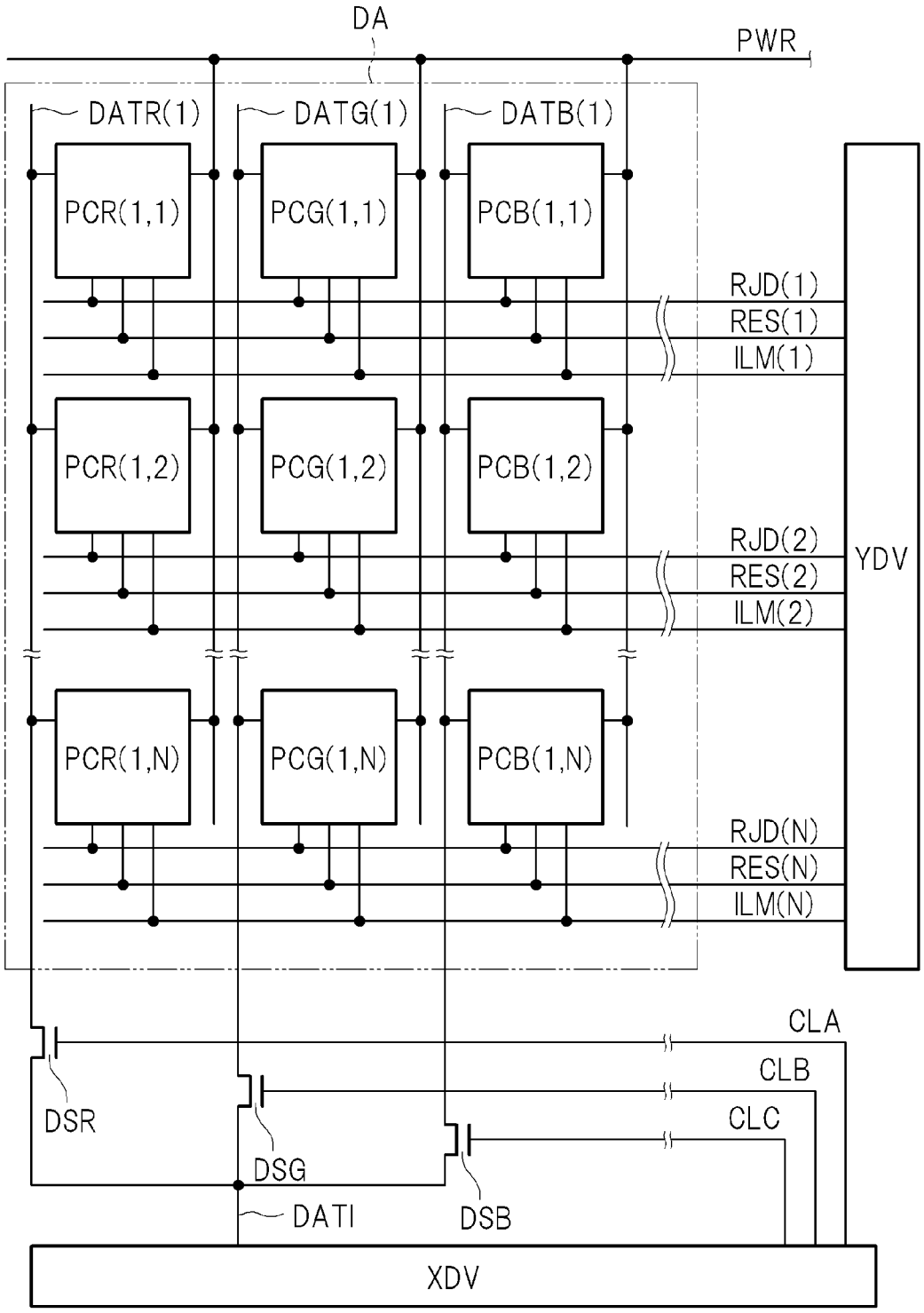
FIG. 1 is a diagram illustrating an example of a circuit configuration of an organic electroluminescent (EL) display device according to a first embodiment of the present invention.

An organic EL display device physically includes an array substrate, a flexible printed circuit board, and a driver integrated circuit encapsulated in a package. On the array substrate, a display region DA for displaying an image is provided. FIG. 1 is a diagram illustrating an example of a circuit configuration of the organic EL display device according to a first embodiment of the present invention. The circuit illustrated in FIG. 1 is mainly provided on the array substrate and in the driver integrated circuit. The display region DA is formed on the array substrate of the organic EL display device, and the display region DA includes pixels arranged in matrix. In each region of pixels PX, three pixel circuits PCR, PCG, and PCB are arranged side by side in the horizontal direction of the figure. The pixel circuit PCR displays red, the pixel circuit PCG displays green, and the pixel circuit PCB displays blue. The pixel circuits PCR, PCB, and PCG are referred to as pixel circuits PC when distinction among emission colors of the pixel circuits PCR, PCB, and PCG is unnecessary. In other words, the pixel circuits PC are divided into three groups depending on the type of display color. Note that, the pixels PX are arranged in M columns and N rows in the display region DA. Note that, the red pixel circuit PCR, the green pixel circuit PCG, and the blue pixel circuit PCB constituting the pixel PX in n-th row and m-th column are denoted by PCR(m,n), PCG(m,n), and PCB(m,n), respectively. Further, the pixel circuits PC are arranged in (3×M) columns and N rows in the display region, and in this embodiment, the pixel circuits PC arranged in the same column display the same color.

In the display region DA, a data line DATR, DATG, or DATB (hereinafter, referred to as data line DAT when distinction among colors corresponding to the pixel circuits PC is unnecessary) and a power supply line PWR for supplying a power supply potential Voled extend for each column of the pixel circuits PC in the vertical direction of the figure, and a data line connection control line RJD, a reset control line RES, and a lighting control line ILM extend for each row of the pixel circuits PC in the horizontal direction of the figure. Further, in a region on the array substrate and below the display region DA in the figure, RGB change-over switches DSR, DSG, and DSB respectively provided for the data lines DATR, DATG, and DATB, an integrated data line DATI, a data line driving circuit XDV, and a vertical scanning circuit YDV are provided. Note that, parts of the data line driving circuit XDV and the vertical scanning circuit YDV are also provided in the driver integrated circuit.

The pixel circuits PC connected to the same data line DAT display the same color. Hereinafter, the data lines DATR, DATG, and DATB for the columns of the pixel circuits PCR, PCG, and PCB constituting the pixels in the m-th column are denoted by DATR(m), DATG(m), and DATB(m), respectively. A data line DAT supplies a data signal to a plurality of pixel circuits PC in the corresponding column. Further, the number of the data line connection control lines RJD, the number of the reset control lines RES, and the number of the lighting control lines ILM are the same as the number (N) of rows of the pixel circuits PC. The data line connection control line RJD, the reset control line RES, and the lighting control line ILM corresponding to the n-th row of the pixel circuits PC are denoted by RJD(n), RES(n), and ILM(n), respectively. One end of each of the data line connection control line RJD, the reset control line RES, and the lighting control line ILM is connected to the vertical scanning circuit YDV.

The RGB change-over switches DSR, DSG, and DSB are n-channel thin film transistors and respectively provided in the number m corresponding to the number of columns of the pixels. The RGB change-over switch DSR has a gate electrode connected to an RGB change-over control line CLA, the RGB change-over switch DSG has a gate electrode connected to an RGB change-over control line CLB, and the RGB change-over switch DSB has a gate electrode connected to an RGB change-over control line CLC.

The data line DATR(m) for the pixel circuits PCR in the m-th column of the pixels has a lower end connected to one end of the RGB change-over switch DSR. Another end of the RGB change-over switch DSR is connected to one end of the integrated data line DATI corresponding to the m-th column of the pixels, of the integrated data lines DATI provided in the number M corresponding to the number of the columns of the pixels. Similarly, the data line DATG(m) has a lower end connected to the one end of the corresponding integrated data line DATI via the RGB change-over switch DSG, and the data line DATB(m) has a lower end connected to the one end of the corresponding integrated data line DATI via the RGB change-over switch DSB. Another end of the integrated data line DATI is connected to the data line driving circuit XDV.

Note that, the RGB change-over switches DSR, DSG, DSB each have a drain electrode connected to the integrated data line DATI, and a source electrode connected to the corresponding data line DAT. Note that, polarities of the source electrode and the drain electrode of the thin film transistor are not structurally determined, but are determined by the direction of the current flowing through the thin film transistor and whether the thin film transistor is of the n-channel type or the p-channel type. Therefore, the connection destinations of the source electrode and the drain electrode of the thin film transistor may be interchanged.

Figure 2:
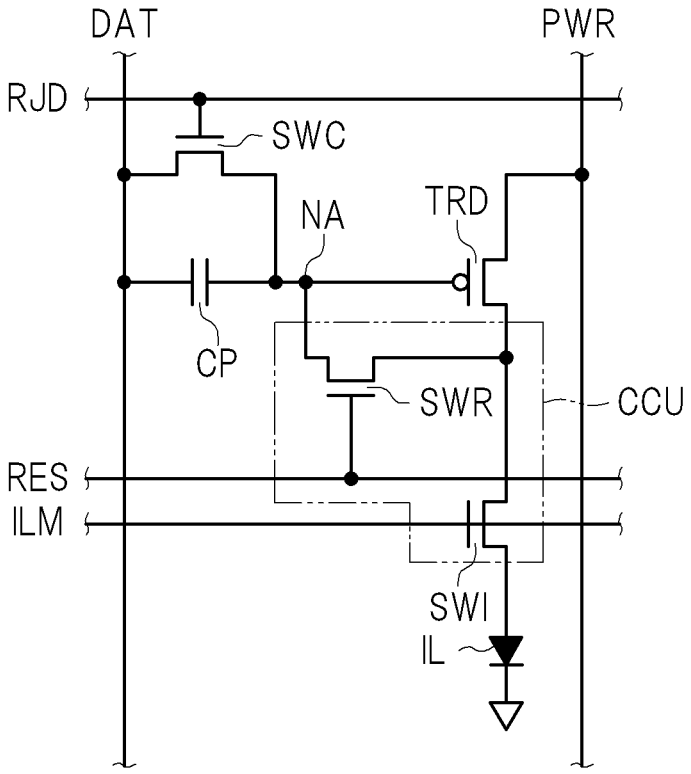
FIG. 2 is a circuit diagram illustrating an example of a configuration of a pixel circuit according to the first embodiment of the present invention.

FIG. 2 is a circuit diagram illustrating an example of a configuration of the pixel circuit PC according to the first embodiment of the present invention. The pixel circuit PC includes a light emitting element IL, a drive transistor TRD, a storage capacitor CP, a data line connection switch SWC, alighting control switch SWI, and a reset switch SWR. The light emitting element IL has a cathode connected to a reference potential supply line (not shown). In this embodiment, the reference potential supply line supplies a reference potential which serves as a reference with respect to the power supply potential Voled supplied from the power supply line PWR and the potential supplied to the data line DAT, the gate electrode of the drive transistor TRD and the lighting control switch SWI or the like. The reference potential may not necessarily be supplied from a grounded electrode. The drive transistor TRD is a p-channel thin film transistor and controls an amount of light emitted from the light emitting element IL depending on a potential difference between potentials applied to a gate electrode and a source electrode thereof. The light emitting element IL has an anode connected to a drain electrode of the drive transistor via the lighting control switch SWI. The storage capacitor CP has one end connected to the gate electrode of the drive transistor TRD. The one end of the storage capacitor CP is also connected to one end of the data line connection switch SWC. Another end of the storage capacitor CP and another end of the data line connection switch SWC are connected to the data line DAT. The reset switch SWR has one end connected to the gate electrode of the drive transistor TRD and another end connected to the drain electrode of the drive transistor TRD. The light emitting element IL is an organic electroluminescent (EL) element and also called organic light-emitting diode (OLED) because the organic EL element generally has diode characteristics.

A node to which the gate electrode of the drive transistor TRD is connected is referred to as a node NA. Further, the reset switch SWR and the lighting control switch SWI together constitute a current path control unit CCU. Note that, the light emitting element IL included in the pixel circuit PCR emits red light, the light emitting element IL included in the pixel circuit PCG emits green light, and the light emitting element IL included in the pixel circuit PCB emits blue light. The data line connection switch SWC, the lighting control switch SWI, and the reset switch SWR are n-channel thin film transistors. The data line connection switch SWC has a gate electrode connected to the data line connection control line RJD, the reset switch SWR has a gate electrode connected to the reset control line RES, and the lighting control switch SWI has a gate electrode connected to the lighting control line ILM.

Figure 3:
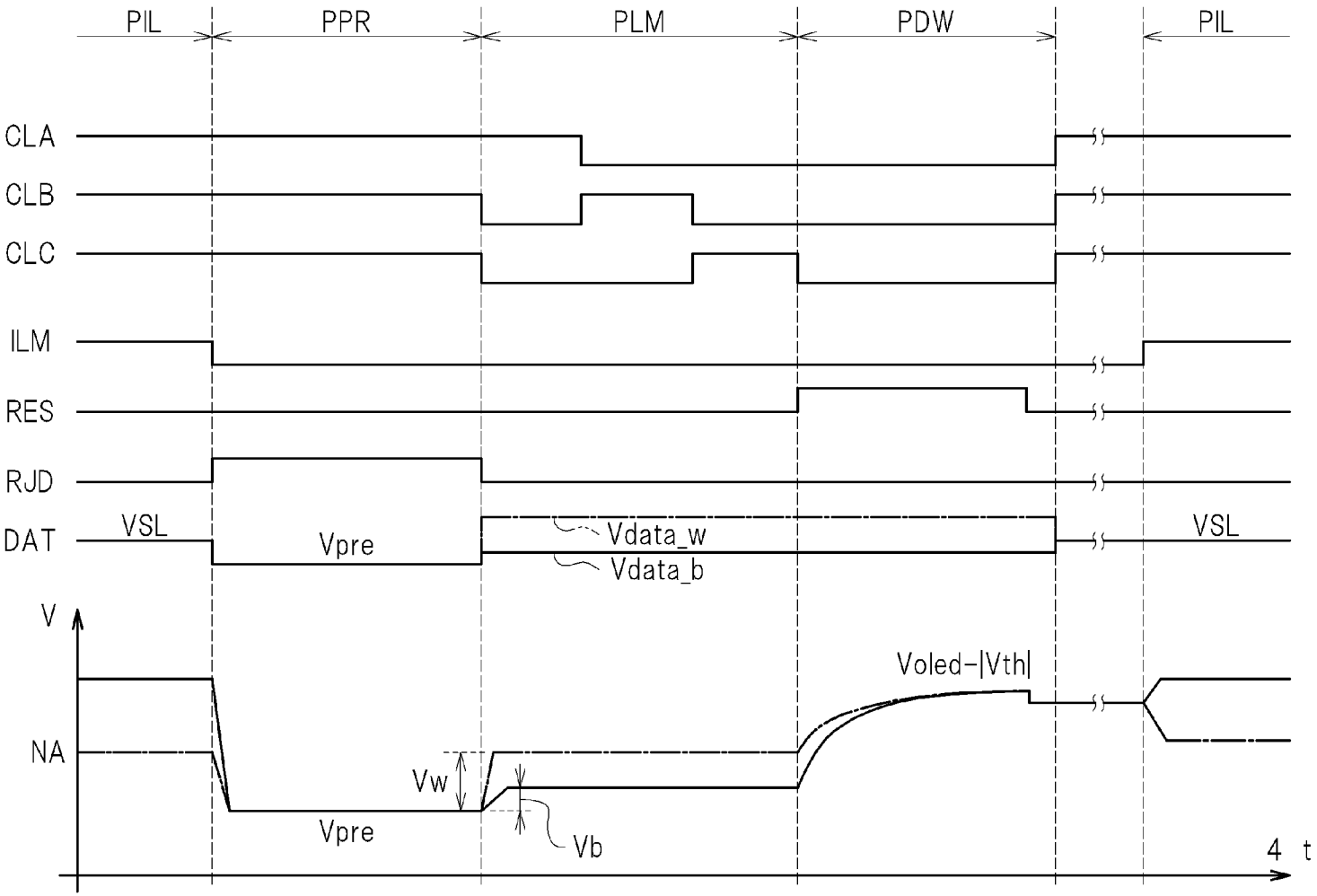
FIG. 3 is a waveform diagram illustrating an example of temporal changes in potentials of RGB change-over control lines, a lighting control line, a reset control line, a data line connection control line, a data line, and a node NA of the pixel circuit illustrated in FIG. 2.

Next, a driving method for the organic EL display device according to this embodiment is described. FIG. 3 is a waveform diagram illustrating an example of temporal changes in potentials of the RGB change-over control lines CLA, CLB, and CLC, the lighting control line ILM, the reset control line RES, the data line connection control line RJD, the data line DAT, and the node NA. In this figure, signals for only the pixel circuits PC in the first row are illustrated. The potential of the node NA is illustrated for two cases: one where a frame (hereinafter, referred to as previous frame) immediately preceding the current frame displays black and the current frame displays black (indicated by the solid line in the figure); and the other where the previous frame displays white and the current frame displays white (indicated by the dashed line in the figure).

Operations for driving one pixel circuit PC are performed in the order of a precharge operation, a data retaining operation, a data storing operation, and an emission operation. The precharge operation is an operation of lowering the gate potential of the drive transistor TRD to a level that can cancel the threshold voltage, and a period in which this operation is performed is referred to as a precharge period PPR. The data retaining operation is an operation of retaining the data signals from the integrated data line DATI indicating the gray levels to be displayed in the data lines DATR, DATG, and DATB, and a period in which this operation is performed is referred to as a data retaining period PLM. The data storing operation is an operation of storing the potential difference corresponding to the gray level to be displayed in the storage capacitor CP, and a period in which this operation is performed is referred to as a data storing period PDW. The emission operation is an operation of causing the light emitting element IL to emit light, and a period in which this operation is performed is referred to as an emission period PIL. A feature of the driving method according to this embodiment is that a period in which the precharge operation, the data retaining operation, and the data storing operation are performed on each pixel circuit PC and the emission period PIL in which the pixel circuits PC in all rows are caused to emit light are clearly separated. In other words, in the period in which the precharge operation, the data retaining operation, and the data storing operation are performed on the pixel circuit PC in any of the rows, none of the pixel circuits PC in the rows is caused to emit light, and after those operations are completed, the pixel circuits PC in all rows are caused to emit light at the same time.

FIGS. 4A to 4D are diagrams illustrating states of the data line connection switch SWC, the lighting control switch SWI, and the reset switch SWR in the pixel circuit PC in the respective periods of the example illustrated in FIG. 3. Referring to FIGS. 3 and 4A to 4D, the driving method and a potential Va of the node NA are described below.

Figure 4A:
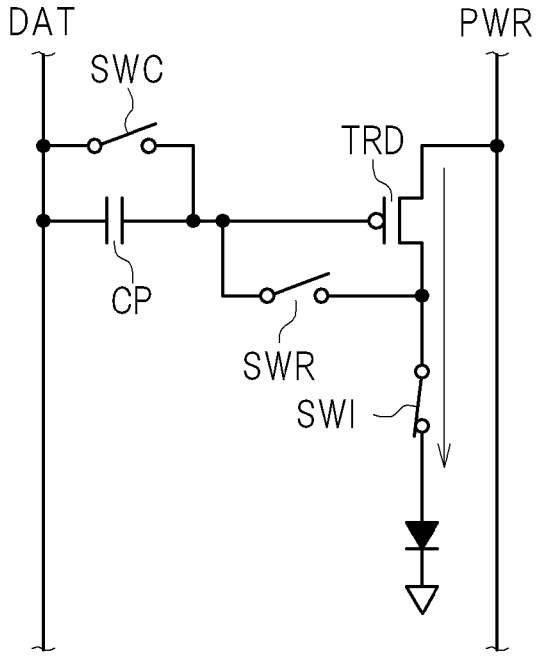
FIG. 4A is a diagram illustrating states of switches in the pixel circuit in an emission period.

First, before the precharge period PPR with respect to the pixel circuit PC in the first row, the light emitting element IL emits light at the gray level displayed in the previous frame. In other words, the pixel circuit PC is in the emission period PIL of the previous frame. In the emission period PIL of the previous frame, the potential Va of the node NA is a potential corresponding to the gray level at which the light is emitted. In the emission period PIL, the lighting control line ILM is HIGH, and the reset control line RES and the data line connection control line RJD are LOW. Accordingly, the lighting control switch SWI is ON, and the data line connection switch SWC and the reset switch SWR are OFF. FIG. 4A is a diagram illustrating states of the switches included in the pixel circuit PC in this emission period PIL. Note that, the potential Va in the emission period PIL becomes higher as the display gray level becomes closer to dark (black) and farther from bright (white). In the emission period PIL, the data line is supplied with a potential VSL of an emission control signal.

Figure 4B:
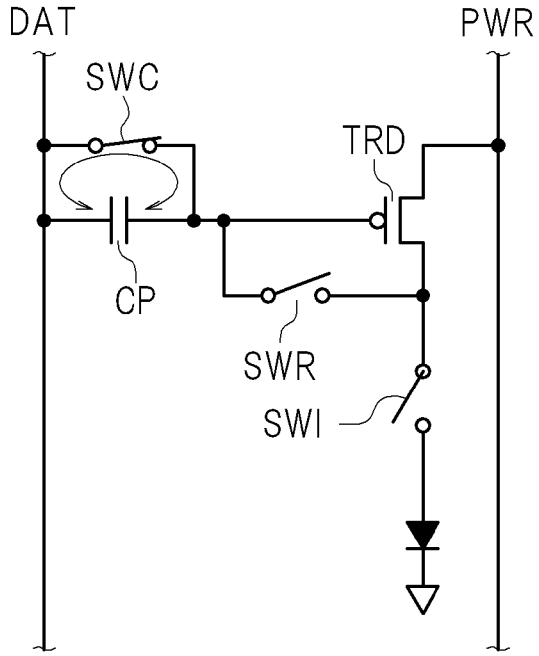
FIG. 4B is a diagram illustrating states of the switches in the pixel circuit in a precharge period.

Then, at the beginning of the precharge period PPR, the potential of the lighting control line ILM becomes LOW and the data line connection control line RJD becomes HIGH. With this state, the lighting control switch SWI is turned OFF to stop light emission of the light emitting element IL, and the data line connection switch SWC is turned ON. FIG. 4B is a diagram illustrating this state. At this time, the reset switch SWR is OFF. When the data line connection control line RJD is turned ON, one end of the storage capacitor CP on the node NA side is connected to the data line DAT. In the precharge period PPR, a precharge potential Vpre is supplied to the data line DAT from the data line driving circuit XDV, and hence the potential Va of the node NA also becomes the precharge potential Vpre.

At this time, the reset switch SWR is OFF, and a current path (first current path) from the power supply line PWR to the one end of the storage capacitor CP on the node NA side via the drive transistor TRD is interrupted. Further, the lighting control switch SWI is also OFF, and a current path (second current path) from the power supply line PWR to the anode of the light emitting element IL via the drive transistor TRD is also interrupted. In other words, in the precharge period PPR, the first current path and the second current path are interrupted by the current path control unit CCU. This prevents voltage drop in the data line DAT caused by a current flowing from the power supply line, even when the light emitting element IL is not supplied with a current. Accordingly, the precharge voltage necessary at the beginning of the data storing period PDW maybe supplied independently of the voltage drop. Note that, when the gray level in the previous frame is black (hereinafter, referred to as the case of the previous frame is black), the potential Va before the precharge operation is the potential at which the drive transistor TRD is turned OFF, and when the gray level in the previous frame is white (hereinafter, referred to as the case where the previous frame is white), the potential Va before the precharge operation is the potential at which the light emitting element IL is caused to emit light at the highest gray level. In this embodiment, the potential Va in the case where the previous frame is white is a potential that is lower than that in the case where the previous frame is black by 5 V.

Figure 4C:
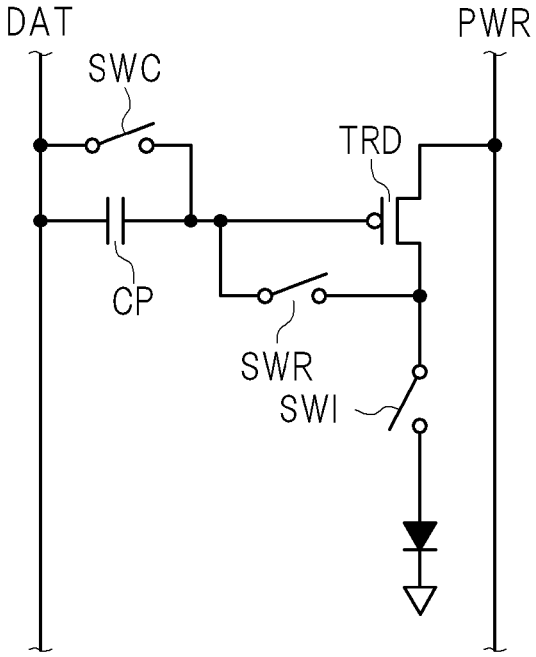
FIG. 4C is a diagram illustrating states of the switches in the pixel circuit in a data retaining period.

At the end of the precharge period PPR followed by the data retaining period PLM, the potential of the data line connection control line RJD becomes LOW and the data line connection switch SWC is turned OFF. FIG. 4C illustrates states of the switches in the data retaining period PLM. Further, the data line driving circuit XDV supplies the data signals sequentially to the data lines DATR, DATG, and DATB. At the beginning of the data retaining period PLM, the RGB change-over control lines CLB and CLC become LOW while the RGB change-over control line CLA remains HIGH, and the RGB change-over switches DSG and DSB are turned OFF and the RGB change-over switch DSR is turned ON so that the integrated data line DATI and the data line DATR are connected to each other. The data line driving circuit XDV writes the data signal through the integrated data line DATI to the data line DATR. At this time, the potential of the node NA illustrated in FIG. 3 is the potential of the node NA in the pixel circuit PC connected to the data line DATR. Charges of the storage capacitor CP are not changed, and hence the potential of the node NA becomes a potential Vdata of the data signal applied to the data line DAT. Specifically, when the amount of change in the potential of the node NA in the case where the display gray level is white is Vw, Vw=Vdata_w-Vpre is established, and when the amount of change in the potential of the node NA in the case where the display gray level is black is Vb, Vb=Vdata_b-Vpre is established, where Vdata_w represents the potential of the data signal in the case where the display gray level is white, and Vdata_b represents the potential of the data signal in the case where the display gray level is black.

Next, the RGB change-over control line CLB becomes HIGH in place of the RGB change-over control line CLA, and the data line driving circuit XDV writes the data signal through the integrated data line DATI to the data line DATG. Similarly, the RGB change-over control line CLC becomes HIGH in place of the RGB change-over control line CLB, and the data line driving circuit XDV writes the data signal through the integrated data line DATI to the data line DATB. After writing to the data line, the RGB change-over switch DSB is turned OFF.

Figure 4D:
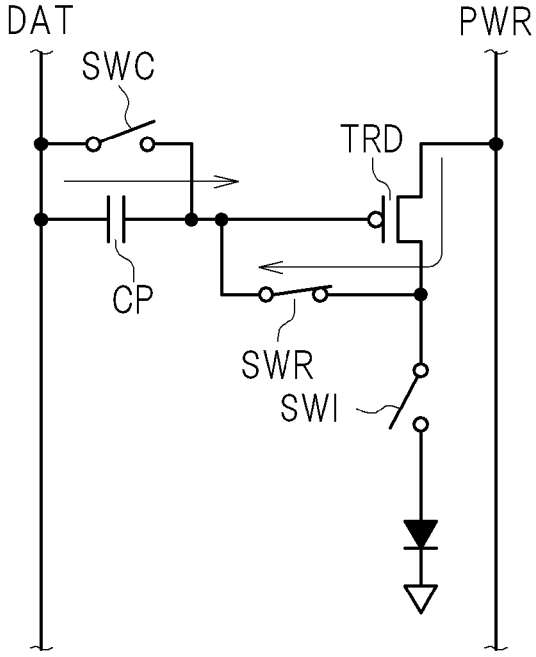
FIG. 4D is a diagram illustrating states of the switches in the pixel circuit in a data storing period.

At the beginning of the data storing period PDW following the data retaining period PLM, the potential of the reset control line RES becomes HIGH, and the reset switch SWR is turned ON. FIG. 4D is a diagram illustrating states of the switches in the data storing period PDW. With this state, the potential of the data signal retained in the data line DAT is supplied to the one end of the storage capacitor CP on the opposite side of the node NA, and the node NA is connected to the drain electrode of the drive transistor TRD.

At the beginning of the data storing period PDW, the potential Va is a potential low enough to turn ON the drive transistor TRD, and hence the drive transistor TRD causes the current to flow so that the gate-source potential difference becomes the threshold voltage both for the case where the previous frame is black and for the case where the previous frame is white. Thereafter, the potential Va approaches Voled−|Vth|, where Vth represents the value of the threshold voltage. Then, at the end of the data storing period PDW, the storage capacitor CP stores the potential differences between the potential Va of the node NA and potentials Vdata b, Vdata_w, or the like of the data signals. Note that, in actuality, a time constant it takes for the potential difference to reach to the threshold voltage is provided. Therefore, in a strict sense, at the timing when the data storing period PDW ends, the potential Va is smaller than Voled−|Vth|, and the storage capacitor CP stores the potential difference that reflects the potential Va.

Then, after the same operations are performed on the pixel circuits PC in other rows, the emission period PIL starts. In the emission period PIL, the potentials of the lighting control line ILM and the RGB switch-over control lines CLA, CLB, and CLC become HIGH and the lighting control switch SWI is turned ON so that the data line DAT is connected to the data line driving circuit XDV to supply the potential VSL of the emission control signal. The current flowing through the drive transistor TRD changes depending on the potential difference between the potential Vdata of the data signal and the potential VSL. Specifically, the potential Va of the node NA at that point in time is expressed as follows:

$$Va = Voled - |Vth| - (V\text{data} - VSL)$$

The amount of the current flowing through the drive transistor TRD is determined by a value obtained by subtracting the threshold voltage from the gate-source potential difference, and hence the amount of the current may be controlled irrespective of the fluctuation in threshold voltage at the time of manufacture of the drive transistor TRD. Accordingly, the light emitting element IL emits light at a luminance corresponding to the potential of the data signal.

Hereinabove, the operations performed on the pixel circuit PC in the first row are described. Also on the pixel circuits PC in the second and subsequent rows, it is necessary to perform the precharge operation, the data retaining operation, and the data storing operation. There are three kinds of the orders of the operations in the other rows. The first method is that, at the time of the precharge operation for the first row, the precharge operations for all other rows are also performed at the same time, and the data retaining operation and the data storing operation are repeated alternately for the second and subsequent rows (hereinafter, referred to as "block precharge"). The second method is that the precharge operation is performed for each row, that is, the precharge operation, the data retaining operation, and the data storing operation are repeated for the second and subsequent rows (hereinafter, referred to as "row precharge"). The third method is a compromise method between the first and second methods, and is that the precharge operations are performed for a predetermined number of rows at the same time. In this embodiment, any of the methods may be performed.

Here, in the case of the block precharge, in the precharge period PPR immediately after the emission period PIL, the lighting control lines ILM and the data line connection control lines RJD corresponding to the pixel circuits PC in all rows become LOW and HIGH, respectively. With this state, the precharge operations are performed on the pixel circuits PC in all rows. Next, for each row, the data retaining operation and the data storing operation are repeated. After the data retaining operation and the data storing operation are performed on the pixel circuits PC in all rows, the emission period PIL starts to perform an emission operation. In this case, one horizontal scanning period is a period obtained by adding together the data retaining period PLM and the data storing period PDW performed on the pixel circuit PC in a row. Further, in the case of the row precharge, the precharge operation, the data retaining operation, and the data storing operation are repeated for each row, and after that, the emission period PIL starts. In this case, one horizontal scanning period is a period obtained by adding together the precharge period PPR, the data retaining period PLM, and the data storing period PDW performed on the pixel circuit PC in a row.

With the above-mentioned operations, data may be written without accompanying light emission, and the precharge voltage necessary at the beginning of the data storing period PDW may be supplied independently of the voltage drop. As a result, the non-uniform in-plane luminance due to the hysteresis caused by the voltage distribution resulting from the voltage drop may be suppressed.

Figure 5:
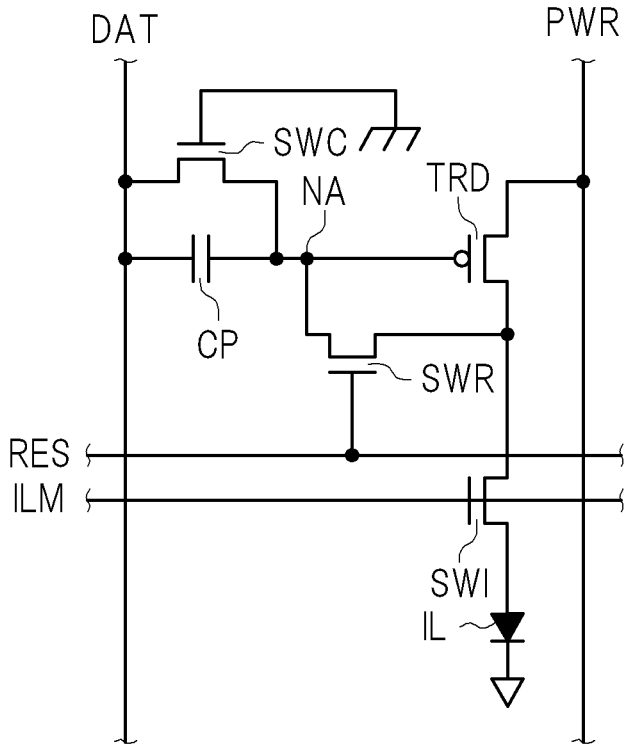
FIG. 5 is a circuit diagram illustrating another example of the configuration of the pixel circuit according to the first embodiment of the present invention.
Figure 6:
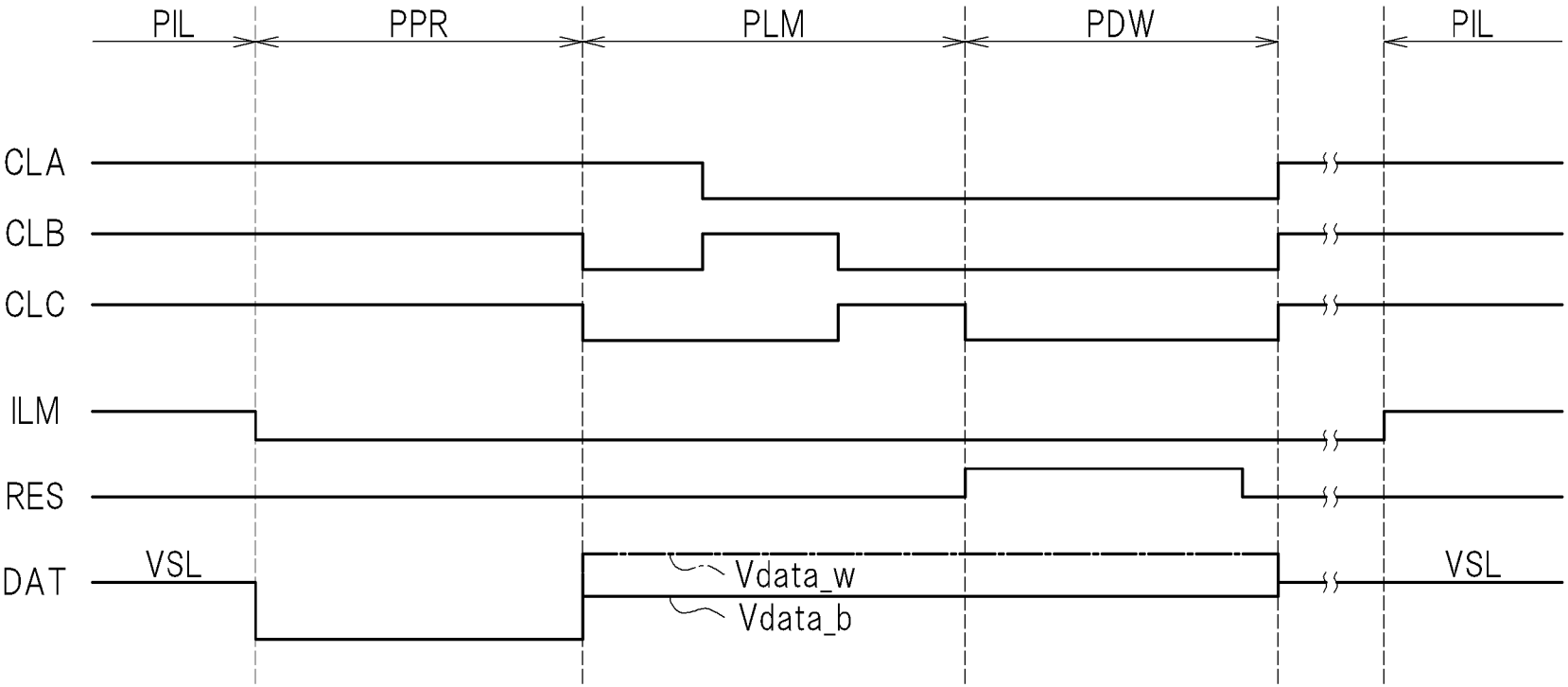
FIG. 6 is a waveform diagram illustrating an example of temporal changes in potentials of RGB change-over control lines, a lighting control line, a reset control line, and a data line of the pixel circuit illustrated in FIG. 5.

Here, it is also possible to omit the data line connection control line RJD. FIG. 5 is a circuit diagram illustrating another example of the configuration of the pixel circuit PC according to the first embodiment. Unlike the example of FIG. 2, the gate electrode of the data line connection switch SWC is supplied with a reference potential. FIG. 6 is a waveform diagram illustrating an example of temporal changes in potentials of the RGB change-over control lines CLA, CLB, and CLC, the lighting control line ILM, the reset control line RES, and the data line DAT of the pixel circuit PC illustrated in FIG. 5. In the precharge period PPR, by setting the potential of the data line DAT to be lower than the reference potential instead of setting the data line connection control line RJD to HIGH, the data line connection switch SWC may be turned ON without providing the data line connection control line RJD. The operations in the data retaining period PLM, the data storing period PDW, and the emission period PIL are the same as those in the example of FIG. 3, and hence descriptions thereof are omitted. Because the wiring line supplying the reference potential is always present in the pixel circuit PC, the data line connection control line RJD may be omitted. Note that, the potential to be supplied to the gate electrode of the data line connection switch SWC is not necessarily the reference potential. The potential may be any potential as long as the potential is out of the range in the potential VSL of the emission control signal or the potential Vdata of the data signal (as long as the potential is lower than the bottom of the range because the pixel circuit PC in this embodiment uses the n-channel transistors).

[Second Embodiment ]

A second embodiment of the present invention is different from the first embodiment mainly in the point that a power supply control switch SWP is provided between the power supply line PWR and the source electrode of the drive transistor TRD. Next, the second embodiment is described, mainly focusing on the difference from the first embodiment.

Figure 7:
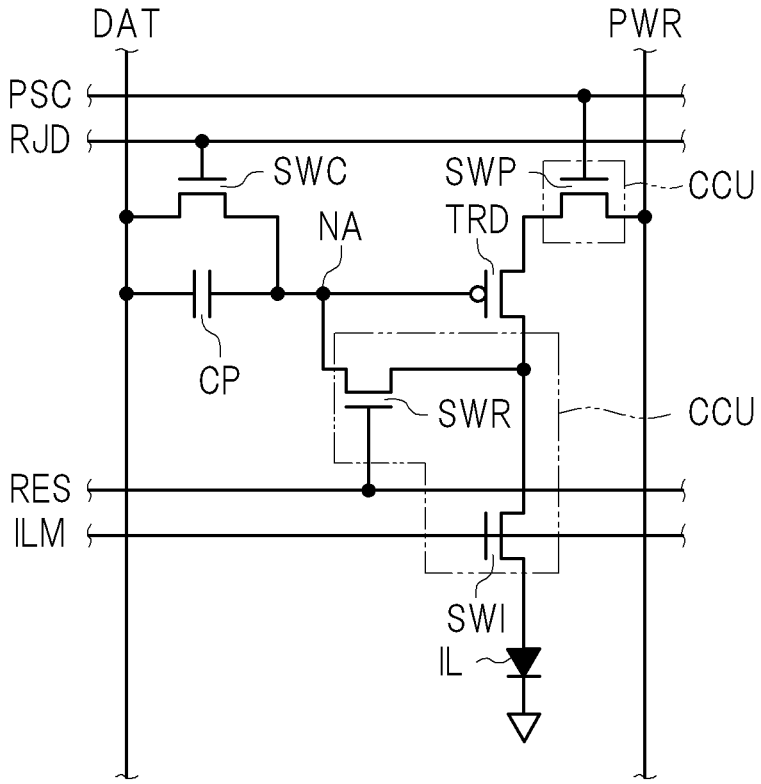
FIG. 7 is a circuit diagram illustrating an example of a configuration of a pixel circuit according to a second embodiment of the present invention.

FIG. 7 is a circuit diagram illustrating an example of a configuration of a pixel circuit PC according to the second embodiment of the present invention. The pixel circuit PC includes a light emitting element IL, a drive transistor TRD, a storage capacitor CP, a data line connection switch SWC, a lighting control switch SWI, a reset switch SWR, and a power supply control switch SWP. The light emitting element IL has a cathode connected to a reference potential supply line (not shown). The light emitting element IL has an anode connected to a drain electrode of the drive transistor via the lighting control switch SWI. The storage capacitor CP has one end connected to a gate electrode of the drive transistor TRD. The one end of the storage capacitor CP is also connected to one end of the data line connection switch SWC. Another end of the storage capacitor CP and another end of the data line connection switch SWC are connected to the data line DAT. The reset switch SWR has one end connected to the gate electrode of the drive transistor TRD and another end connected to the drain electrode of the drive transistor TRD. The power supply control switch SWP has one end connected to a source electrode of the drive transistor TRD and another end connected to the power supply line PWR.

Further, the power supply control switch SWP, the reset switch SWR, and the lighting control switch SWI together constitute a current path control unit CCU. The data line connection switch SWC, the lighting control switch SWI, the reset switch SWR, and the power supply control switch SWP are n-channel thin film transistors. In this embodiment, a power supply control line PSC is provided for each row of the pixel circuits PC. The data line connection switch SWC has a gate electrode connected to the data line connection control line RJD, the reset switch SWR has a gate electrode connected to the reset control line RES, the lighting control switch SWI has a gate electrode connected to the lighting control line ILM, and the power supply control switch SWP has a gate electrode connected to the power supply control line PSC.

Figure 8:
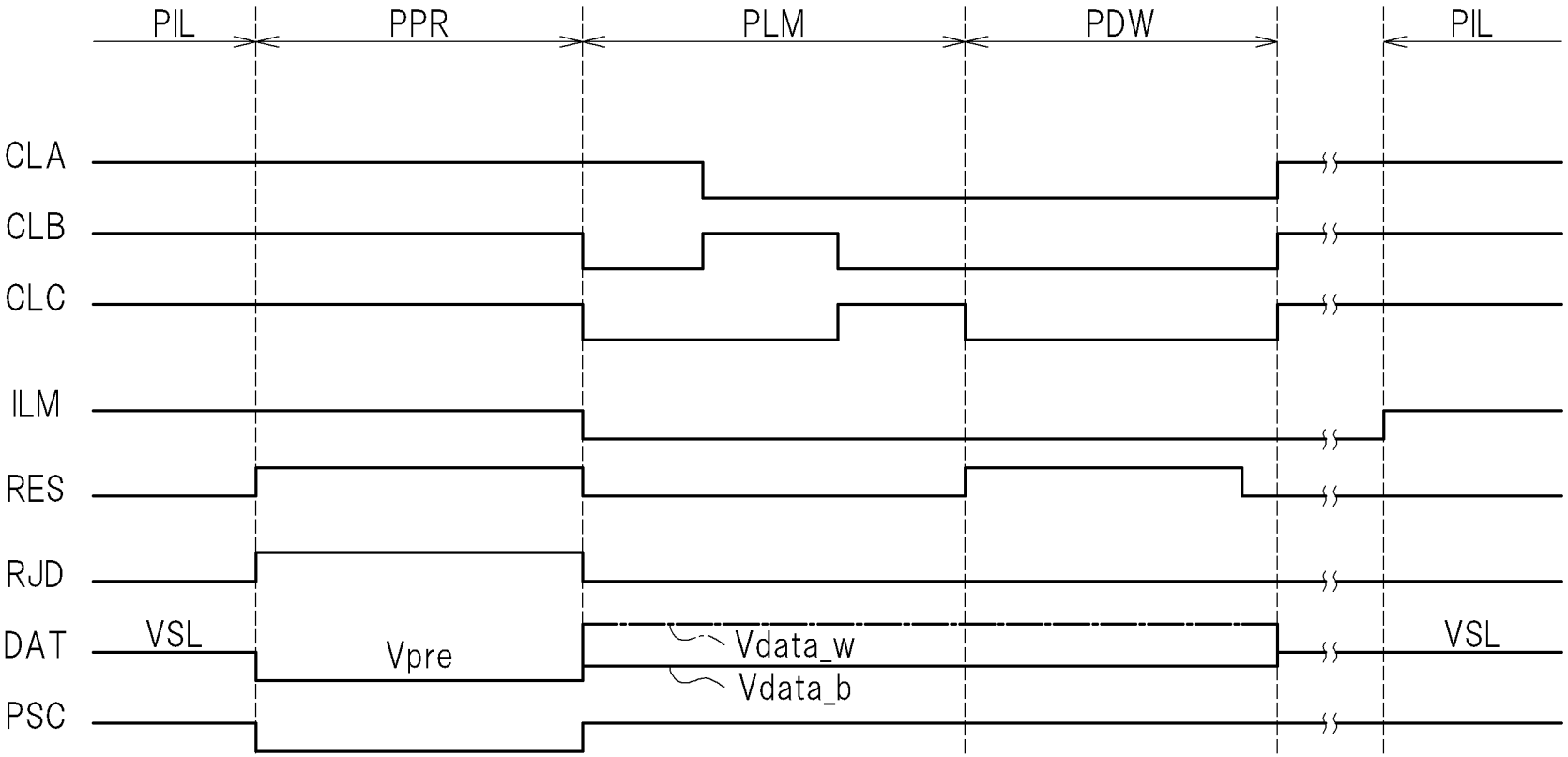
FIG. 8 is a waveform diagram illustrating an example of temporal changes in potentials of RGB change-over control lines, a lighting control line, a reset control line, a data line connection control line, a data line, and a power supply control line of the pixel circuit illustrated in FIG. 7.

Next, a driving method for an organic EL display device according to this embodiment is described. FIG. 8 is a waveform diagram illustrating an example of temporal changes in potentials of the RGB change-over control lines CLA, CLB, and CLC, the lighting control line ILM, the reset control line RES, the data line connection control line RJD, the data line DAT, and the power supply control line PSC. In this figure, signals for only the pixel circuits PC in the first row are illustrated. The second embodiment is the same as the first embodiment in the point that the pixel circuits are driven in the order of the precharge operation, the data retaining operation, the data storing operation, and the emission operation.

Figure 9:
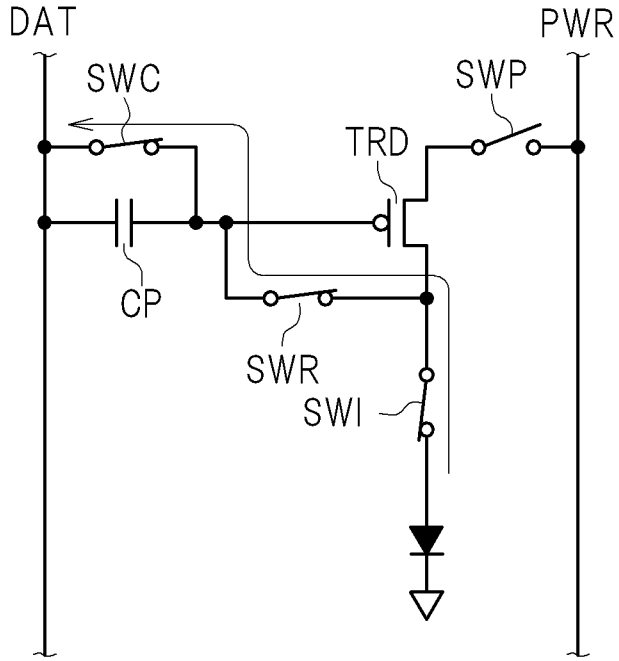
FIG. 9 is a diagram illustrating states of switches in the pixel circuit illustrated in FIG. 7 in a precharge period.

In this embodiment, in the precharge period PPR, the potential of the power supply control line PSC becomes LOW, and the potentials of the lighting control line ILM and the reset control line RES become HIGH. Accordingly, the power supply control switch SWP is OFF, the lighting control switch SWI is ON, and the reset switch SWR is ON. FIG. 9 is a diagram illustrating states of the switches included in the pixel circuit illustrated in FIG. 7 in the precharge period PPR. Because the data line connection switch SWC is turned ON, charges stored in the storage capacitor CP flow to the data line DAT, and the potential of the node NA becomes the precharge potential Vpre. On the other hand, because the power supply control switch SWP included in the current path control unit CCU is turned OFF, the first current path from the power supply line PWR to the node NA and the second current path from the power supply line PWR to the light emitting element IL are interrupted. Further, the anode of the light emitting element IL is electrically connected to the data line DAT via the lighting control switch SWI, the reset switch SWR, and the data line connection switch SWC so as to secure a current path from the light emitting element IL to one end of the storage capacitor CP on the node NA side. With this, the charges stored in the light emitting element IL are also discharged. Therefore, even if the voltage generated across the light emitting element IL is changed due to the change in potential of the lighting control line ILM or the like, the voltage is prevented from exceeding the threshold voltage, with the result that the micro-emission of the light emitting element IL may be further suppressed as compared to the first embodiment, thereby improving the contrast.

Figure 10:
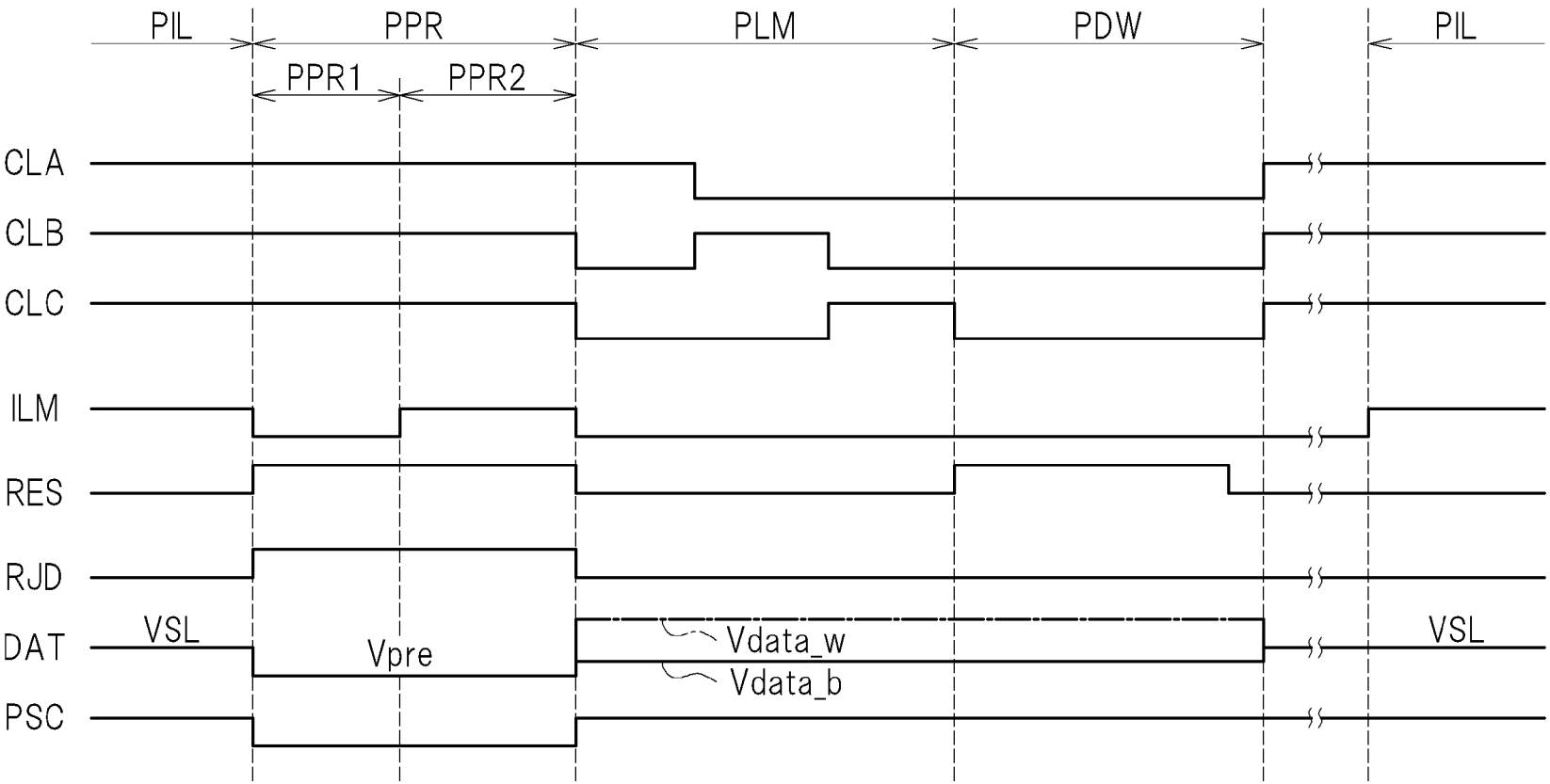
FIG. 10 is a waveform diagram illustrating another example of the temporal changes in potentials of the RGB change-over control lines, the lighting control line, the reset control line, the data line connection control line, the data line, and the power supply control line of the pixel circuit illustrated in FIG. 7.
Figure 11:
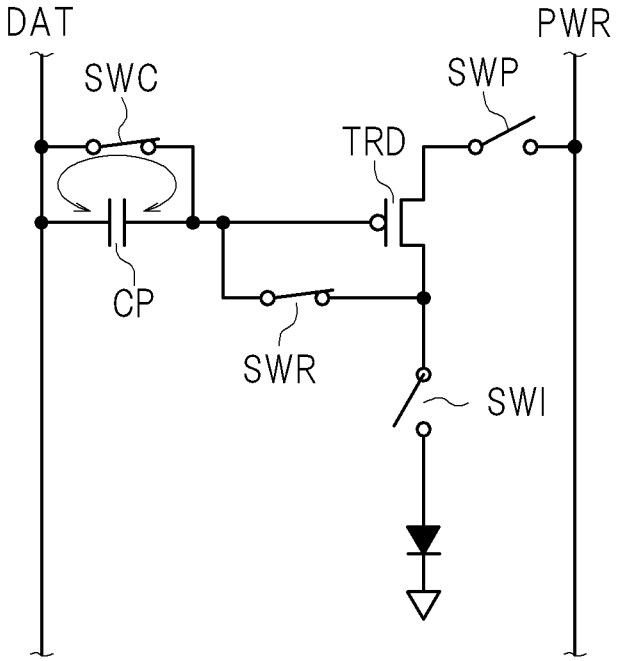
FIG. 11 is a diagram illustrating states of the switches in a first-half precharge period illustrated in FIG. 10.

Here, in the case of the driving method illustrated in FIG. 8, there is a fear that the charges flow from the storage capacitor CP to the light emitting element IL in the precharge period PPR. A driving method which solves the fear is described below. FIG. 10 is a waveform diagram illustrating another example of the temporal changes in potentials of the RGB change-over control lines CLA, CLB, and CLC, the lighting control line ILM, the reset control line RES, the data line connection control line RJD, the data line DAT, and the power supply control line PSC. The precharge period PPR is divided into a first-half precharge period PPR1 and a second-half precharge period PPR2. FIG. 10 is different from FIG. 8 in the point that, in the first-half precharge period PPR1, the lighting control line ILM becomes LOW, and in the second-half precharge period PPR2 following the first-half precharge period PPR1, the lighting control line ILM becomes HIGH. FIG. 11 is a diagram illustrating states of the switches in the first-half precharge period PPR1 illustrated in FIG. 10. The states of FIG. 11 are the same as those in the precharge period PPR of FIG. 8 in the point that the data line connection switch SWC is turned ON and the power supply control switch SWP included in the current path control unit CCU is turned OFF to interrupt the first current path and the second current path, but different in the point that the anode of the light emitting element IL is not electrically connected to the data line DAT. This eliminates the fear that the charges of the storage capacitor CP flow to the light emitting element IL to cause the micro emission, to thereby improve the contrast more. Note that, at this timing, the reset switch SWR may be turned OFF. In the second-half precharge period PPR2, the lighting control line ILM becomes HIGH, and the anode of the light emitting element IL is electrically connected to the data line DAT via the lighting control switch SWI, the reset switch SWR, and the data line connection switch SWC. With this, a current path from the light emitting element IL to one end of the storage capacitor CP on the node NA side may be secured so that the charges stored in the light emitting element IL are discharged via the data line DAT. The states and operations of the switches at this time are the same as those illustrated in FIG. 9.

Note that, similarly to the example of FIG. 5 according to the first embodiment, the gate electrode of the data line connection switch SWC may be supplied with the reference potential.

[Third Embodiment ]

A third embodiment of the present invention is different from the first embodiment mainly in the point that the lighting control switch SWI is shared among the plurality of pixel circuits PC. Next, the third embodiment is described, mainly focusing on the difference from the first embodiment.

Figure 12:
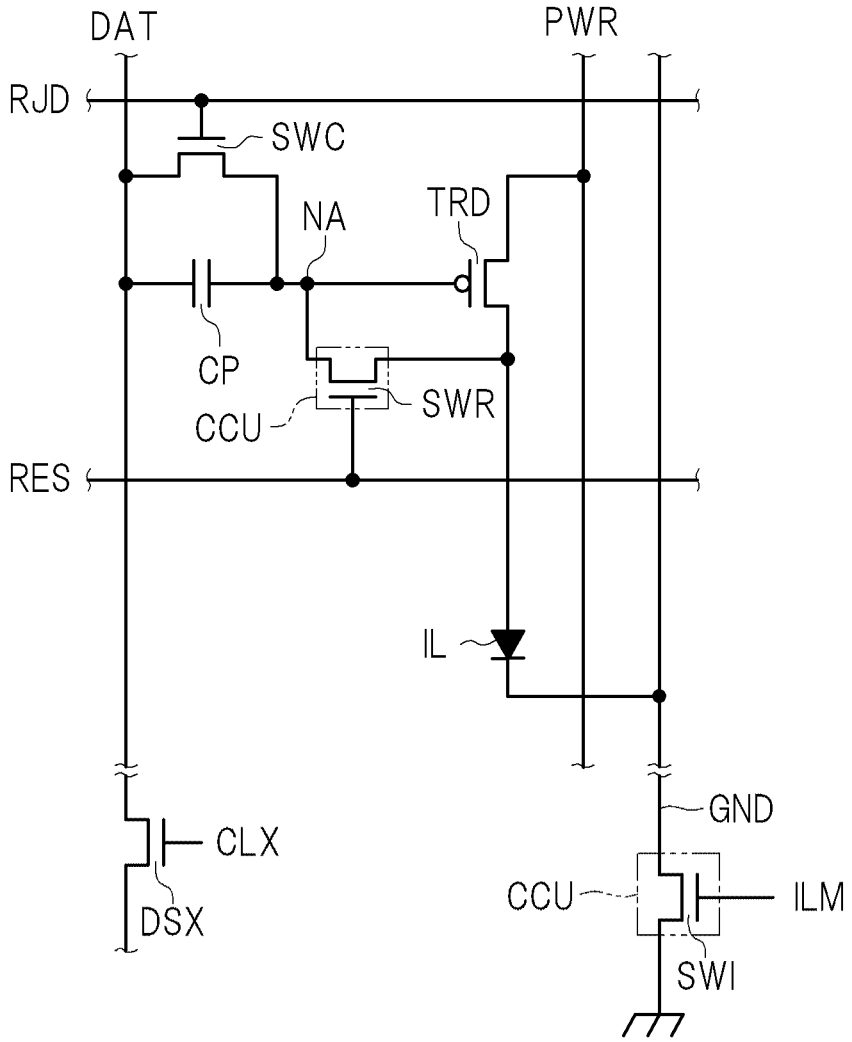
FIG. 12 is a diagram illustrating an example of a configuration of a pixel circuit according to a third embodiment of the present invention.

FIG. 12 is a diagram illustrating an example of a configuration of a pixel circuit according to the third embodiment. In this embodiment, in addition to the power supply line PWR and the data line DAT, a reference potential supply line GND extends in the vertical direction of the figure for each column of the pixel circuits PC. Further, for each row of the pixel circuits PC, the data line connection control line RJD and the reset control line RES extend in the horizontal direction of the figure. The data line DAT is connected to one end of an RGB change-over switch DSX, which is anyone of the RGB change-over switches DSR, DSG, and DSB. The RGB change-over switch DSX is an n-channel thin film transistor. Further, a gate electrode of the RGB change-over switch DSX is connected to an RGB change-over control line CLX, which is any one of the RGB change-over control lines CLA, CLB, and CLC. The lighting control line ILM extends in a peripheral region outside the display region DA (on the lower side of the figure) in the horizontal direction of the figure, which intersects the reference potential supply line GND.

The pixel circuit PC includes a light emitting element IL, a drive transistor TRD, a storage capacitor CP, a data line connection switch SWC, and a reset switch SWR. The light emitting element IL has a cathode connected to the reference potential supply line GND. The light emitting element IL has an anode connected to a drain electrode of the drive transistor TRD. The storage capacitor CP has one end connected to a gate electrode of the drive transistor TRD. The one end of the storage capacitor CP is also connected to one end of the data line connection switch SWC. Another end of the storage capacitor CP and another end of the data line connection switch SWC are connected to the data line DAT. The reset switch SWR has one end connected to the gate electrode of the drive transistor TRD and another end connected to the drain electrode of the drive transistor TRD. A cathode of the light emitting element IL included in the pixel circuit PC in the same column is connected to the same reference potential supply line GND. The lighting control switch SWI is provided between the reference potential supply line GND and a reference potential supply source.

The reset switch SWR and the lighting control switch SWI together constitute the current path control unit CCU. The data line connection switch SWC, the reset switch SWR, and the lighting control switch SWI are n-channel thin film transistors. The data line connection switch SWC has a gate electrode connected to the data line connection control line RJD, the reset switch SWR has a gate electrode connected to the reset control line RES, and the lighting control switch SWI has a gate electrode connected to the lighting control line ILM.

Also in this embodiment, by the driving method according to the first embodiment illustrated in FIG. 3, the pixel circuit PC may be caused to emit light at a luminance corresponding to the data signal. This is because, as illustrated in FIG. 3, in the precharge period PPR, the data retaining period PLM, and the data storing period PDW, the potentials of the lighting control lines ILM in all the rows are LOW and hence the operation timing is not changed even if the lighting control switch SWI is shared. With this, while obtaining the effects of the first embodiment that the voltage drop in the data line DAT and the micro emission of the light emitting element IL at the time of the precharge operation may be suppressed, the number of thin film transistors disposed in the pixel circuit PC may be reduced so that the degree of freedom on the circuit layout may be increased.

The power supply control switch SWP as described in the second embodiment may be provided in the pixel circuit PC. In this case, the driving method illustrated in FIG. 8 or FIG. 10 may be employed, but the precharge operations need to be performed on all rows at the same time (block precharge).

Figure 13:
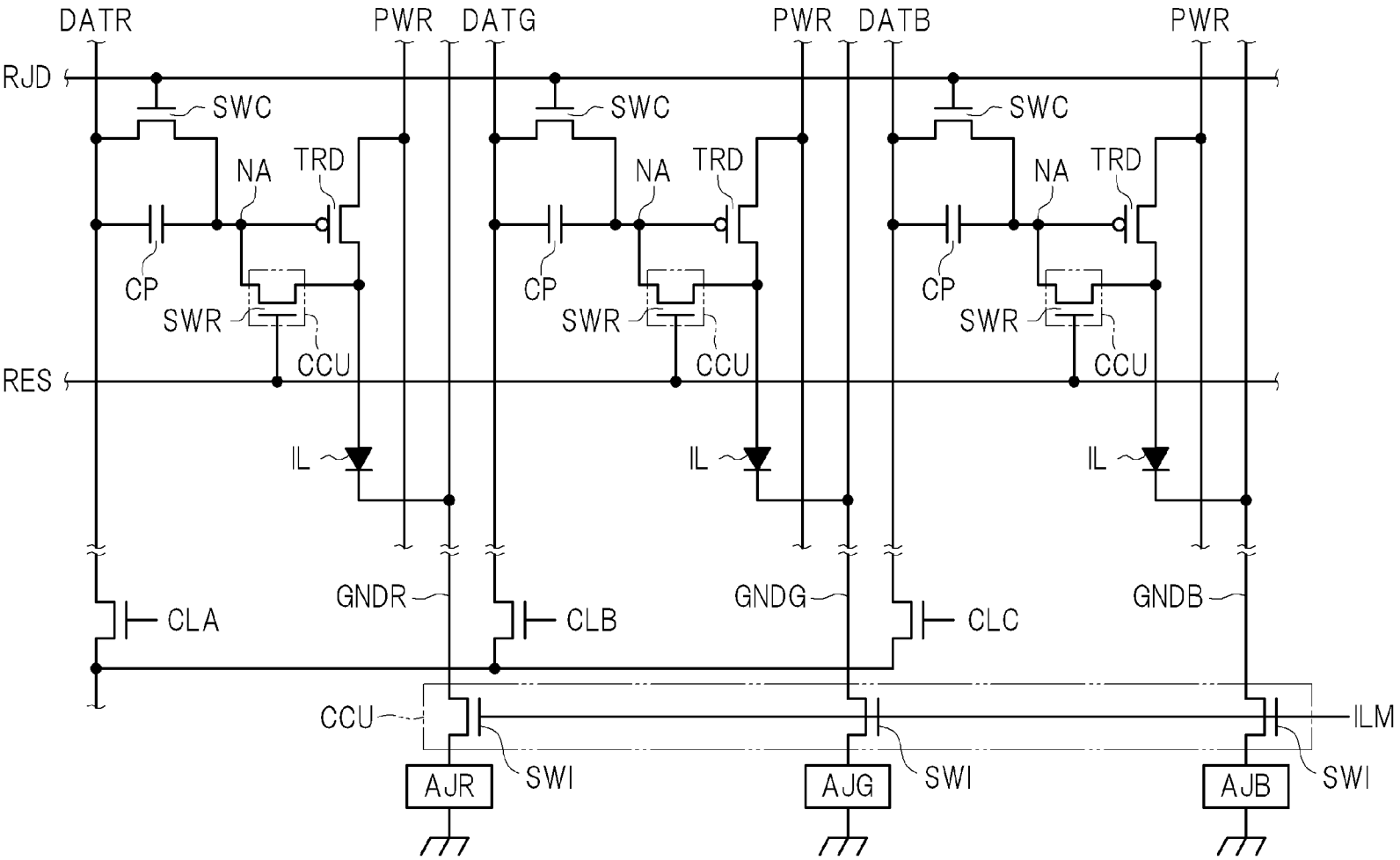
FIG. 13 is a diagram illustrating another example of the configuration of the pixel circuits according to the third embodiment of the present invention.
Figure 14:
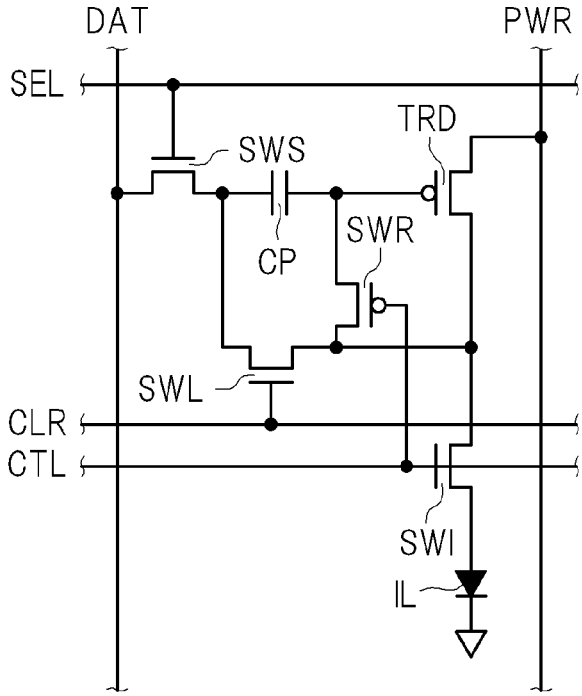
FIG. 14 is a diagram illustrating an example of a pixel circuit of a conventional image display device.
Figure 15:
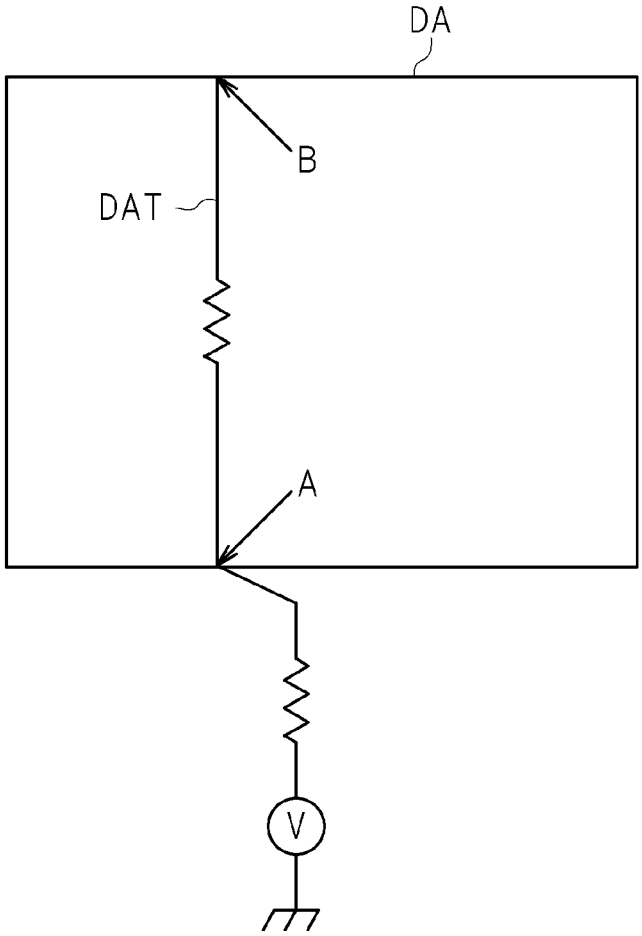
FIG. 15 is a diagram schematically illustrating a resistance of a data line and a resistance of a wiring line connected thereto.

As an extended example of FIG. 12, a circuit for supplying a potential depending on the type of light emitting element IL may be provided between the reference potential supply source and the reference potential supply line GND. FIG. 13 is a diagram illustrating another example of the configuration of the pixel circuits according to the third embodiment. The reference potential supply line GND is provided for each column of the pixel circuits PC. The pixel circuits PC in the same column display the same color, that is, belong to the same group. A reference potential supply line GNDR corresponds to the column of the pixel circuits PCR, a reference potential supply line GNDG corresponds to the column of the pixel circuits PCG, and a reference potential supply line GNDB corresponds to the column of the pixel circuits PCB.

The configuration in the pixel circuit PC is the same as that of the example of FIG. 12, but different in the point that the connection destination of the cathode of the light emitting element IL is the reference potential supply line GND corresponding to the emission color group to which the pixel circuit PC concerned belongs. The lighting control switch SWI is provided for each group of the pixel circuits PC or each reference potential supply line GND. Potential adjusting circuits AJR, AJG, and AJB are provided for each group of the pixel circuits PC, and supply potentials depending on the type of emission color of the light emitting elements IL, respectively. The light emitting elements IL have different characteristics including threshold voltages depending on the emission color. The potential adjusting circuits AJR, AJG, and AJB may make adjustments so as to absorb the difference in emission caused by the different characteristics. The potential adjusting circuit AJR corresponds to the group of the pixel circuits PCR, the potential adjusting circuit AJG corresponds to the group of the pixel circuits PCG, and the potential adjusting circuit AJB corresponds to the group of the pixel circuits PCB. The lighting control switch SWI has one end connected to the corresponding reference potential supply line GND and another end connected to the corresponding one of the potential adjusting circuits AJR, AJG, and AJB. In other words, the lighting control switch corresponding to a certain group controls the connection between the reference potential supply line GND and the potential adjusting circuit corresponding to that group.

Also in the example of FIG. 13, by using the driving method described in the example of FIG. 12, the effect of suppressing the voltage drop in the data line DAT and the micro emission of the light emitting element IL at the time of the precharge operation may be obtained, and further the effects that the degree of freedom on the circuit configuration is improved and that it becomes easy to deal with the difference in characteristics of the light emitting elements IL may be obtained.

While there have been described what are at present considered to be certain embodiments of the invention, it will be understood that various modifications may be made thereto, and it is intended that the appended claims cover all such modifications as fall within the true spirit and scope of the invention.

What is claimed is:

1. An image display device, comprising:

a plurality of pixel circuits;

a power supply line;

a data line for supplying a data signal to each of the plurality of pixel circuits; and a current path control unit, wherein:

the each of the plurality of pixel circuits comprises:

a light emitting element which emits light at a luminance corresponding to an amount of current;

a drive transistor for controlling a current flowing to the light emitting element;

a storage capacitor provided between the data line and a gate electrode of the drive transistor, for storing a potential difference corresponding to a display gray level; and a data line connection switch for connecting a first end of the storage capacitor and the data line, where the first end of the storage capacitor is an end directly connected to the gate electrode of the drive transistor; wherein, before the data line supplies the data signal to each of the plurality of pixel circuits, the data line connection switch included in corresponding one of the plurality of pixel circuits is turned ON by the current path control unit to interrupt a first current path from the power supply line to the first end of the storage capacitor included in the corresponding one of the plurality of pixel circuits.

2. The image display device according to claim 1, wherein, when the data line connection switch included in each of the plurality of pixel circuits is turned ON, the current path control unit interrupts the first current path and a second current path from the power supply line to the light emitting element included in corresponding one of the plurality of pixel circuits.

3. The image display device according to claim 2, wherein the current path control unit comprises:

a reset switch provided between the gate electrode and a drain electrode of the drive transistor included in the each of the plurality of pixel circuits; and a lighting control switch for controlling ON/OFF of the current flowing from the drive transistor to the light emitting element included in the each of the plurality of pixel circuits.

4. The image display device according to claim 3, further comprising:

at least one reference potential supply line; and a reference potential supply source for supplying a reference potential, wherein:

the light emitting element included in each of the plurality of pixel circuits is provided between the drain electrode of the drive transistor included in corresponding one of the plurality of pixel circuits and any one of the at least one reference potential supply line; and the lighting control switch is provided between the any one of the at least one reference potential supply line and the reference potential supply source.

5. The image display device according to claim 4, further comprising a plurality of potential adjusting circuits, wherein:

the plurality of pixel circuits are divided into a plurality of groups depending on an emission color of the light emitting element included in corresponding one of the plurality of pixel circuits;

the at least one reference potential supply line, the lighting control switch, and one of the plurality of potential adjusting circuits are provided for each of the plurality of groups;

the light emitting element included in the pixel circuit which belongs to one of the plurality of groups is provided between the drain electrode of the drive transistor included in the pixel circuit and the at least one reference potential supply line corresponding to the one of the plurality of groups;

the lighting control switch corresponding to any one of the plurality of groups controls connection between the at least one reference potential supply line and one of the plurality of potential adjusting circuits corresponding to the any one of the plurality of groups; and the plurality of potential adjusting circuits each supply a potential corresponding to the corresponding one of the plurality of groups.

6. The image display device according to claim 2, wherein the current path control unit comprises a power supply control switch provided between the power supply line and a source electrode of the drive transistor included in each of the plurality of pixel circuits.

7. The image display device according to claim 6, wherein:

the current path control unit further comprises:

a reset switch provided between the gate electrode and a drain electrode of the drive transistor included in the each of the plurality of pixel circuits; and a lighting control switch for controlling ON/OFF of the current flowing from the drain electrode of the drive transistor to the light emitting element included in corresponding one of the plurality of pixel circuits; and when the data line connection switch is turned ON, the reset switch and the lighting control switch are turned ON.

8. The image display device according to claim 1, wherein the data line connection switch comprises a field effect transistor and has a gate electrode supplied with a predetermined potential.

9. A driving method for an image display device comprising a power supply line, a data line, and pixel circuits each including a light emitting element which emits light at a luminance corresponding to an amount of current, a storage capacitor, a drive transistor including a gate electrode connected to the data line via the storage capacitor, for controlling a current flowing to the light emitting element based on a potential difference stored in the storage capacitor, a reset switch provided between the gate electrode and a drain electrode of the drive transistor, and a data line connection switch for turning ON/OFF connection between a first end of the storage capacitor on the drive transistor side and the data line, where the first end of the storage capacitor is an end directly connected to the gate electrode of the drive transistor, the driving method comprising:

a precharge step of turning ON the data line connection switch and interrupting a first path of a current flowing from the power supply line to the first end of the storage capacitor and a second path of a current flowing from the power supply line to the light emitting element; and after the precharge step, a data storing step of inputting, by the data line, a data signal to a second end of the storage capacitor while turning ON the reset switch.

10. The driving method for an image display device according to claim 9, wherein the precharge step comprises turning ON the data line connection switch and turning OFF the reset switch, and interrupting a path of a current flowing from the drain electrode of the drive transistor to the light emitting element.

11. The driving method for an image display device according to claim 9, wherein the precharge step comprises turning ON the data line connection switch and interrupting a current path between the power supply line and a source electrode of the drive transistor.

12. The driving method for an image display device according to claim 11, wherein the precharge step comprises turning ON the data line connection switch and interrupting a current path between the power supply line and a source electrode of the drive transistor, and securing a current path from the light emitting element to the one end of the storage capacitor.

13. The driving method for an image display device according to claim 11, wherein the precharge step comprises turning ON the data line connection switch and interrupting a current path between the power supply line and a source electrode of the drive transistor, and securing a current path from the light emitting element to the one end of the storage capacitor thereafter.

14. An image display device, comprising:

a plurality of pixel circuits;

a power supply line; and a data line for supplying a data signal and an emission control signal to the plurality of pixel circuits, wherein each of the plurality of pixel circuits comprises:

a light emitting element which emits light at a luminance corresponding to an amount of current;

a drive transistor including a source electrode connected to the power supply line;

a storage capacitor including a first end connected to a gate electrode of the drive transistor and a second end connected to the data line;

a data line connection switch including a first end directly connected to the first end of the storage capacitor, and a second end directly connected to the data line;

a reset switch provided between the gate electrode and a drain electrode of the drive transistor; and a lighting control switch provided between an anode of the light emitting element and the drain electrode of the drive transistor.

15. An image display device, comprising:

a plurality of pixel circuits;

a power supply line; and a data line for supplying a data signal and an emission control signal to the plurality of pixel circuits, wherein each of the plurality of pixel circuits comprises:

a light emitting element which emits light at a luminance corresponding to an amount of current;

a drive transistor;

a storage capacitor including a first end connected to a gate electrode of the drive transistor and a second end connected to the data line;

a data line connection switch including a first end directly connected to the first end of the storage capacitor, and a second end directly connected to the data line;

a reset switch provided between the gate electrode and a drain electrode of the drive transistor;

a lighting control switch provided between an anode of the light emitting element and the drain electrode of the drive transistor; and a current supply switch including a first end connected to the power supply line and a second end connected to a source electrode of the drive transistor.

* * * * *